US010610060B2

(12) United States Patent
Ball et al.

(10) Patent No.: US 10,610,060 B2
(45) Date of Patent: Apr. 7, 2020

(54) SHOWER DOOR ASSEMBLIES AND METHODS FOR INSTALLING SAME

(71) Applicant: Kohler Co., Kohler, WI (US)

(72) Inventors: Matthew Ball, Sheboygan, WI (US); Adam M. Moller, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/966,516

(22) Filed: Apr. 30, 2018

(65) Prior Publication Data

US 2018/0242795 A1 Aug. 30, 2018

Related U.S. Application Data

(62) Division of application No. 14/997,289, filed on Jan. 15, 2016, now Pat. No. 9,974,415.

(60) Provisional application No. 62/105,007, filed on Jan. 19, 2015.

(51) Int. Cl.
*A47K 3/34* (2006.01)

(52) U.S. Cl.
CPC ..... *A47K 3/34* (2013.01)

(58) Field of Classification Search
CPC ..... A47K 3/34; E06B 3/46; E06B 3/4636
USPC ..... 4/607, 610, 557; 16/87.6 R; 49/251
See application file for complete search history.

(56) References Cited

U.S. PATENT DOCUMENTS 3,359,573 A * 12/1967 Casebolt ..... A47K 3/34 4/607

* cited by examiner

*Primary Examiner* — Lauren A Crane
(74) *Attorney, Agent, or Firm* — Foley & Lardner LLP

(57) ABSTRACT

A guide member for a sliding shower door assembly includes a first wall and a second wall. The second wall is offset from the first wall defining a channel therebetween. The channel is configured to receive a portion of a door panel. At least one of the first wall and the second wall includes an undulating surface defined by a plurality of protrusions and valleys.

19 Claims, 13 Drawing Sheets

SHOWER DOOR ASSEMBLIES AND METHODS FOR INSTALLING SAME

CROSS-REFERENCE TO RELATED PATENT APPLICATIONS

This application is a Divisional of U.S. patent application Ser. No. 14/997,289, filed Jan. 15, 2016, which claims the benefit of and priority to U.S. Provisional Application No. 62/105,007, filed Jan. 19, 2015. The entire disclosures of the foregoing applications are hereby incorporated by reference herein.

BACKGROUND

The present application relates generally to shower assemblies, and more specifically, to shower door assemblies and methods for installing the same.

Generally speaking, a sliding shower door assembly includes one or more door panels in rolling engagement with respective rails of a door header. Each of the door panels are configured to translate or slide along the rails within the header to allow for ingress and egress of a user from, for example, a shower or a bathing enclosure. Typically, sliding shower door assemblies use a guide member located at a bottom of the assembly to help position and/or align the doors in a vertical direction and to help guide the doors in a lateral direction when the doors are translated along the respective rails within the header (e.g., when opening or closing the doors). Many existing guide members are noisy due to frictional engagement between a portion of the doors and the guide member when the doors are moved and/or slid relative to the guide member. Furthermore, the doors may stick, rattle or catch within channels of the guide member, thereby creating an undesirable feel or sound for a user.

In addition, most shower door assemblies include one or more door bumpers which may be located at the ends of the header and/or along the end walls of the shower, such as at a wall jamb. Alternatively, the bumpers may be part of a door panel assembly. The bumpers are configured to provide endpoints for sliding of the doors and to protect the doors by providing a soft, elastic surface for the doors to contact. These conventional bumpers are unsightly and can be positioned incorrectly within the shower door assembly, because the bumpers do not include locating features for positioning the bumpers relative to other components of the shower door assembly.

Many conventional sliding shower door assemblies also include a bracket for mounting a roller or wheel to the door. The roller is configured for rolling engagement with the rail of the header to allow the door panel to slide (i.e., translate) along the rail. The bracket typically includes a flange that extends upward from a top edge of the door and includes a plurality of holes, or an elongated slot, for mounting the roller at different vertical positions, to thereby allow for selective adjustment of the door height relative to the fixed structure (e.g., the shower enclosure base or floor) or to tilt the panel relative to a wall of the bathing or shower enclosure. The flange typically extends a significant distance above the top edge of the door, thereby requiring a large amount of clearance or space within the header to fully enclose the flange. Thus, most shower door headers have a size (e.g., a height) that is dictated by the size of the door bracket flange.

Finally, the installation of most shower door assemblies requires a significant amount of effort by an installer, including, for example, measuring and marking locations for drilling holes, mounting various components (e.g., headers, frame rails, guide members, etc.), aligning various components, and hanging door assemblies.

Accordingly, it would be advantageous to provide a shower door assembly having: a guide member that reduces sliding door noise and that improves the translational and/or tactile feel for a user when moving the shower doors; a door bumper that may be easily mounted within the assembly relative to other components and that is aesthetically pleasing; and a door bracket for hanging shower doors that reduces the overall size (e.g., height, clearance, etc.) of the header. Furthermore, it would be advantageous to provide a method for installing a shower door assembly that includes the use of templates and/or locating elements and an installation sequence that simplifies the installation of various components of the shower door assembly. These and other advantageous features will become apparent to those reviewing the present disclosure.

SUMMARY

According to an exemplary embodiment, a shower door assembly includes a first door panel, defining a hole in an upper portion thereof, and a bracket assembly. The bracket assembly includes a bracket having opposing first and second bracket flanges, each bracket flange defining a plurality of corresponding holes at different positions above a bottom end of the bracket flange. The bracket assembly further includes a bushing having opposing first and second bushing flanges, each bushing flange defining a mounting hole. The bracket assembly further includes an axle and a roller. Each bushing flange engages an opposite side of the first door panel and each bracket flange engages a bushing flange. The axle extends through a hole in each bracket flange, a mounting hole in each bushing flange, and the hole in the first door panel. The roller is rotatably coupled to the axle.

According to another exemplary embodiment, a guide member for a shower door assembly includes a rear wall, a middle wall offset from the rear wall defining a first channel therebetween, the first channel configured to receive a first door panel, and a front wall offset from the middle wall defining a second channel therebetween, the second channel configured to receive a second door panel. At least one of the rear, middle, and front walls defines a surface having a plurality of protrusions and valleys.

According to another exemplary embodiment, a method of installing a bathing enclosure includes aligning a bracket on a shower door with a notch in a first rail of a shower door header, inserting a roller coupled to the bracket through the notch in the first rail, and lowering the roller through the notch in the first rail until the roller engages a second rail of the shower door header.

DETAILED DESCRIPTION

Referring generally to the FIGURES, disclosed herein are shower door assemblies and methods for installing the same that include: a door guide member that reduces door noise and provides improved translational and/or tactile feel for a user; a door bumper that includes features for locating the bumper relative to other components of the door assembly and is aesthetically pleasing; a door bracket for hanging shower doors that is configured to reduce the overall size (e.g., height, clearance, etc.) of the header; and an installation sequence that utilizes templates and/or locating elements for simplifying the installation of various components of the shower door assembly.

Figure 1A:
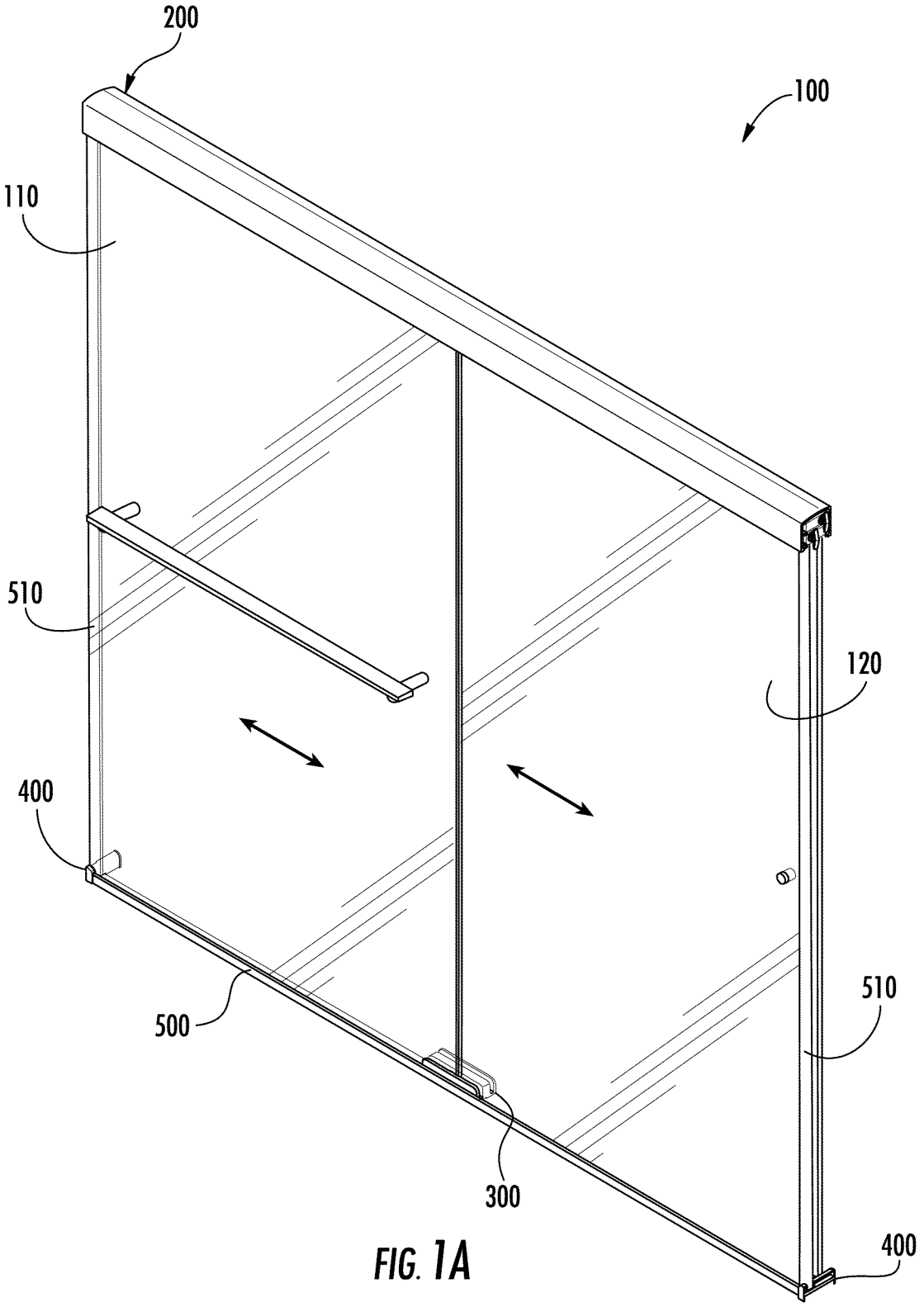
FIG. 1A is a perspective view of a shower door assembly according to an exemplary embodiment.
Figure 1B:
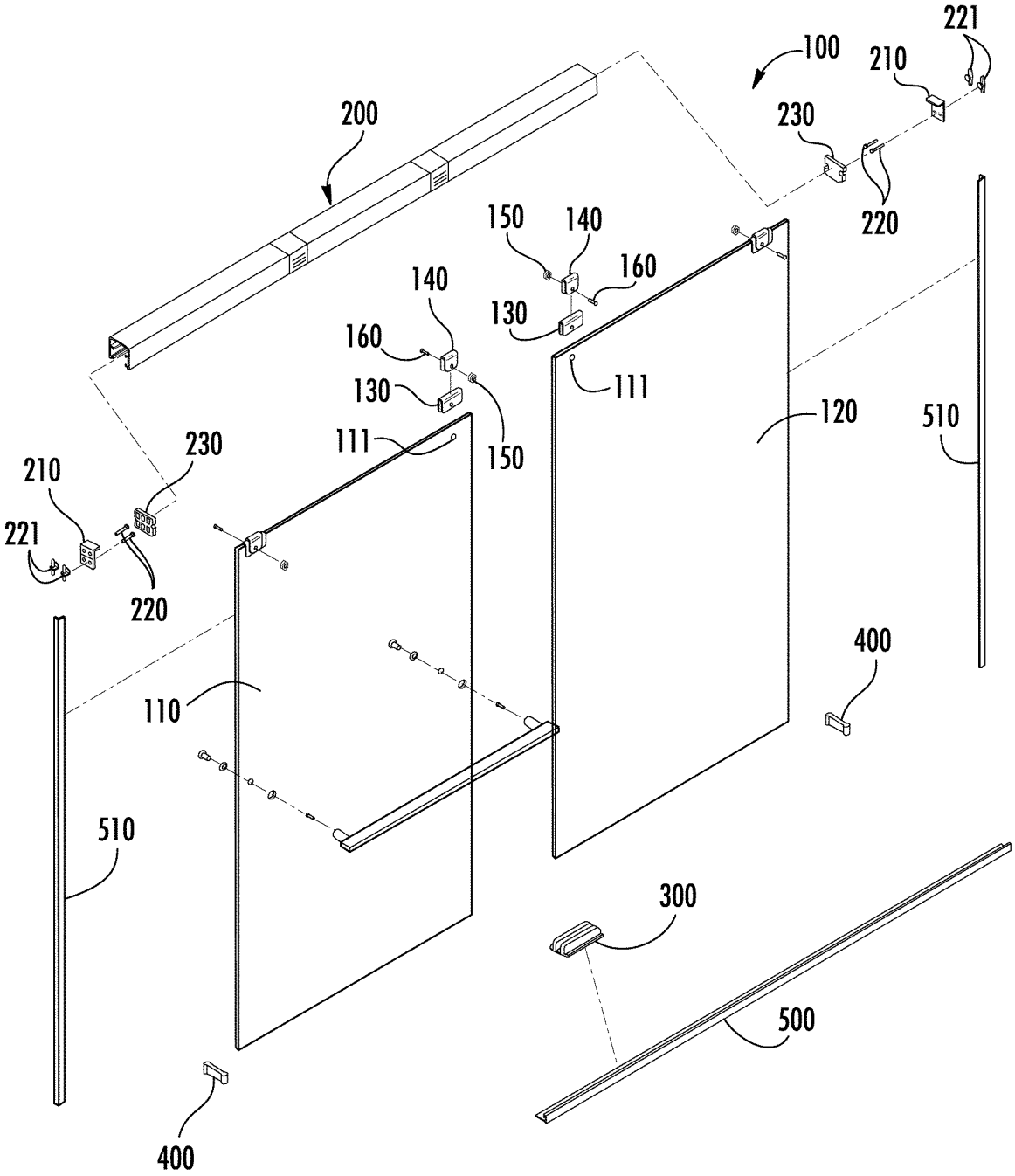
FIG. 1B is an exploded view of the shower door assembly of FIG. 1A.

Referring now to FIGS. 1A and 1B, a shower door assembly 100 is shown according to an exemplary embodiment. The shower door assembly 100 may be installed in, for example, a bathing enclosure, a shower enclosure, or another similar type of bathing environment. The shower door assembly 100 is configured to be coupled to a fixed structure, such as a wall of a bathing or shower enclosure, a wall of a building, a joist, a ceiling, or another type of fixed wall or fixed portion of a building. The shower door assembly 100 is configured to enable ingress and egress of a user from, for example, a shower or bath. The shower door assembly 100 is shown as a sliding shower door assembly, although it should be appreciated that some of the various components and installation methods disclosed herein may be used in conjunction with other types of shower door assemblies having different configurations (e.g., a different number of door panels, door panels having different shapes, sizes, etc.), according to other exemplary embodiments (not shown).

As shown in FIGS. 1A and 1B, the shower door assembly 100 includes a header assembly 200. The header assembly 200 is configured to be coupled to a fixed structure, such as between two fixed walls of a shower or bathing enclosure, walls of a building, a pair of joists, or the like. The header assembly 200 is further configured to receive one or more door panels, such as outer door panel 110 and inner door panel 120, within the header assembly 200. Each of the outer and inner door panels 110 and 120 are in rolling engagement with respective rails of the header assembly 200 (shown in FIGS. 2A and 5D), so as to enable a user to slide (i.e., translate, move, etc.) each of the door panels 110 and 120 between opened and closed positions.

Figure 2A:
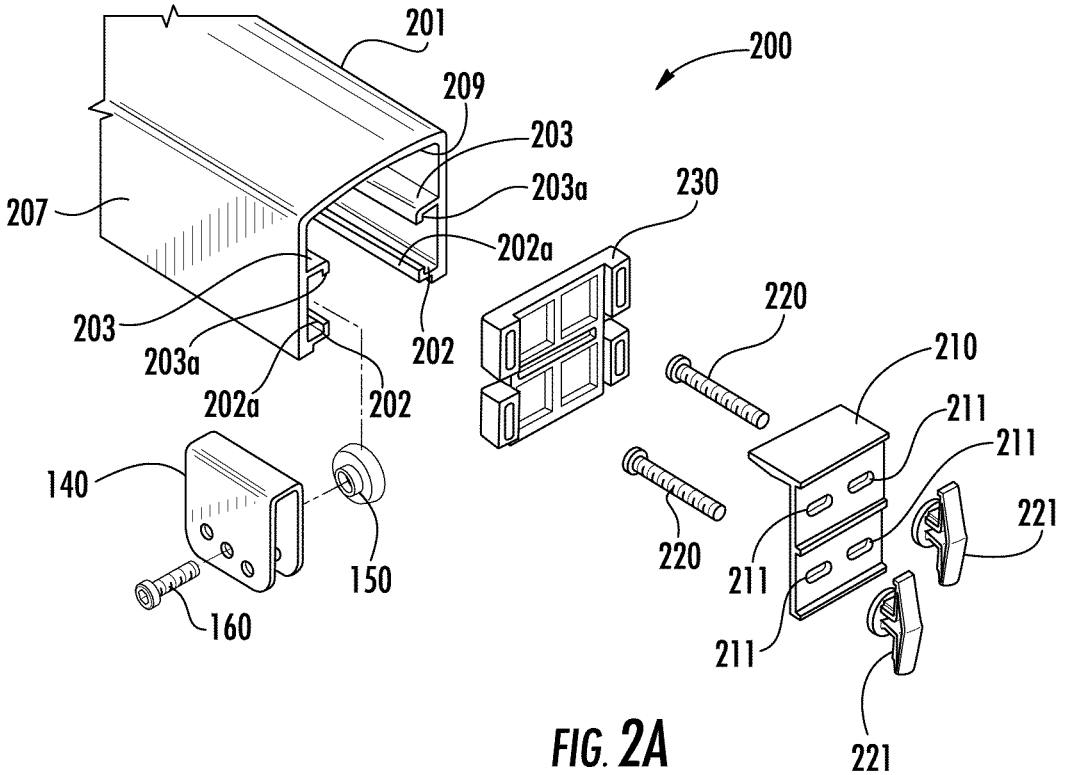
FIG. 2A is a partial perspective view of a header assembly for the shower door assembly of FIG. 1A.

Referring now to FIGS. 2A-2G, the header assembly 200 includes a header 201 and a pair of mounting cleats 210 (e.g., flanges, plates, etc.) for coupling the header 201 to the fixed structure. As shown in FIGS. 2A and 5D, the header 201 includes a pair of opposing lower rails 202 extending from opposing header walls 207 in a lateral direction along a length of the header 201. A lip 202*a* extends upward from each lower rail 202 to prevent and/or impede lateral movement of each of the shower door panels 110 and 120 between the lip 202*a* and the header wall 207. The lower rails 202 are configured to receive one or more rollers 150 (e.g., bearing wheels, etc.) of the door panels 110 and 120. The rollers 150 are configured to be in rolling engagement with the respective lower rails 202 such that a user may selectively move (e.g., slide, etc.) the outer and/or inner door panels 110 and 120 relative to the header 201. The header 201 further includes a pair of upper rails 203 disposed above the lower rails 202. The upper rails 203 extend in a lateral direction parallel to the lower rails 202. The upper rails 203 are configured to prevent and/or impede upward movement of the door panels 110 and 120 by constricting a roller 150 of each door panel between the lower rail 202 and the upper rail 203. A lip 203*a* extends downward from each upper rail 203 to prevent and/or impede lateral movement of each of the shower door panels 110 and 120 between the lip 203*a* and the header wall 207. In addition, referring to FIGS. 2C-2G, each of the upper rails 203 includes a plurality of notches 205 defined by the upper rail 203 and corresponding lip 203*a* and disposed near a middle portion of the header 201. Where the notches 205 exist, the upper rail 203 does not limit the upward movement of the door panels 110 and 120. The notches 205 are configured to facilitate the installation and removal of the outer and inner door panels 110 and 120 to/from the lower rails 202, respectively. That is, the notches 205 provide an open area where a user or an installer may insert the rollers 150 of the outer and inner door panels 110 and 120 therethrough so as to engage the lower rails 202. Likewise, the user or installer may remove the outer and inner door panels 110 and 120 from the lower rails 202 by aligning the rollers 150 with the notches 205 and lifting the door panel upward so as to disengage each of the rollers 150 from the lower rail 202 through each notch 205.

Figure 2B:
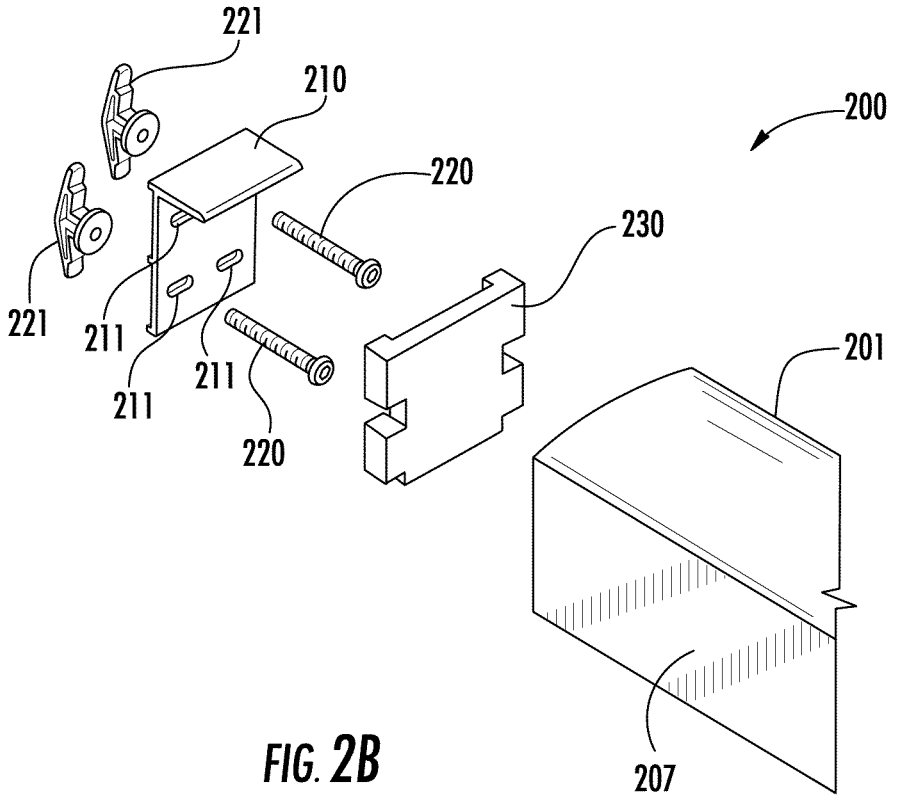
FIG. 2B is another partial perspective view of the header assembly of FIG. 2A.
Figures 2C, 2D:
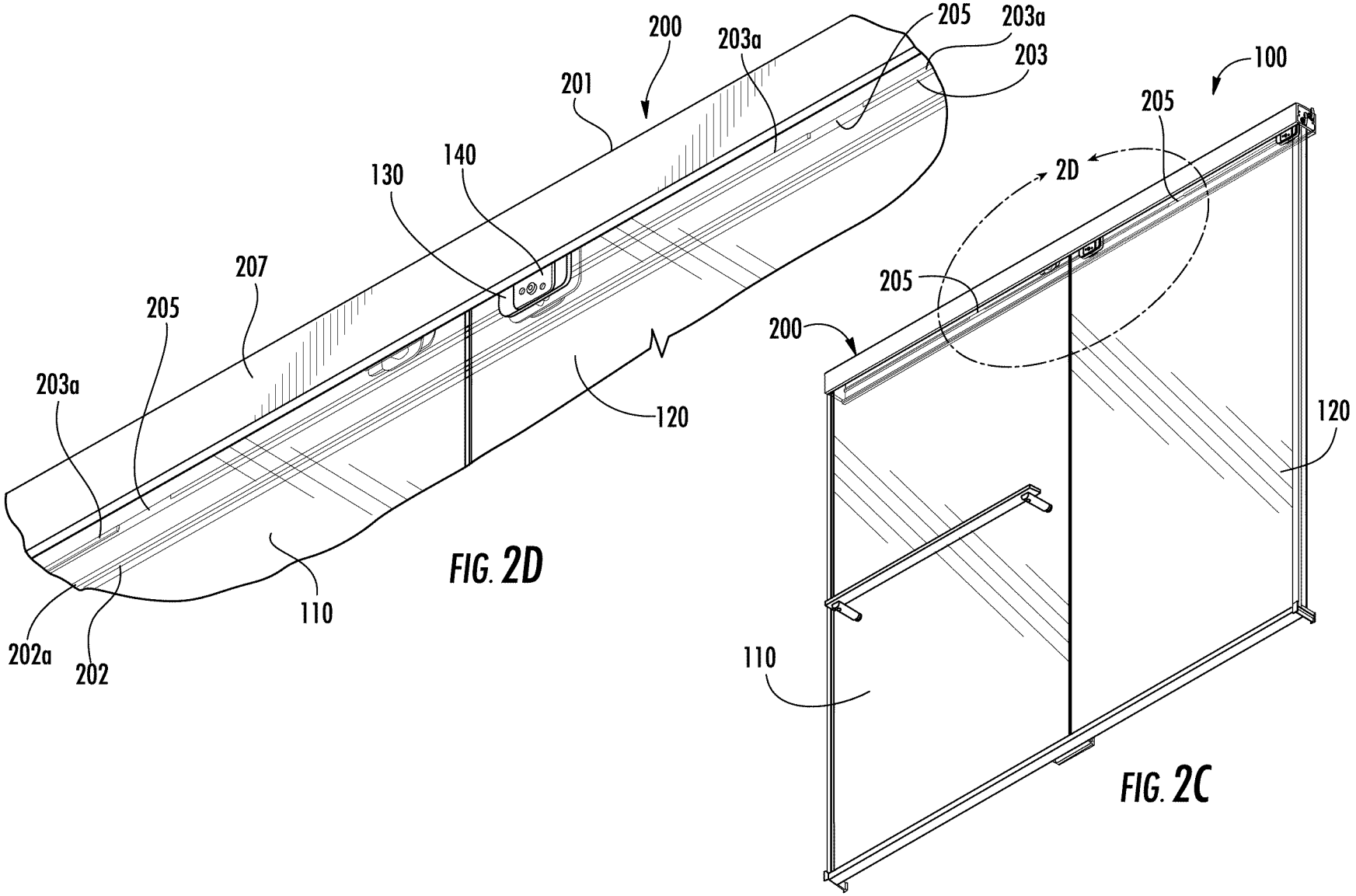
FIG. 2C is a bottom perspective view of the shower door assembly of FIG. 1A showing two door panels installed according to an exemplary embodiment.
FIG. 2D is a partial perspective view of the shower door assembly of FIG. 2C.
Figure 2G:
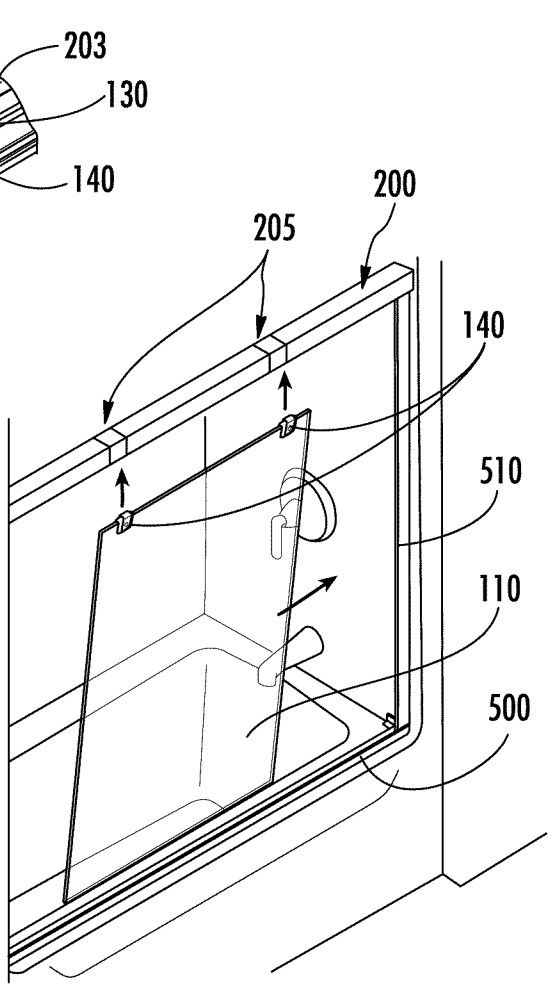
FIG. 2G is a perspective view of a method of installing a door panel in a shower door assembly according to an exemplary embodiment.
Figure 2E:
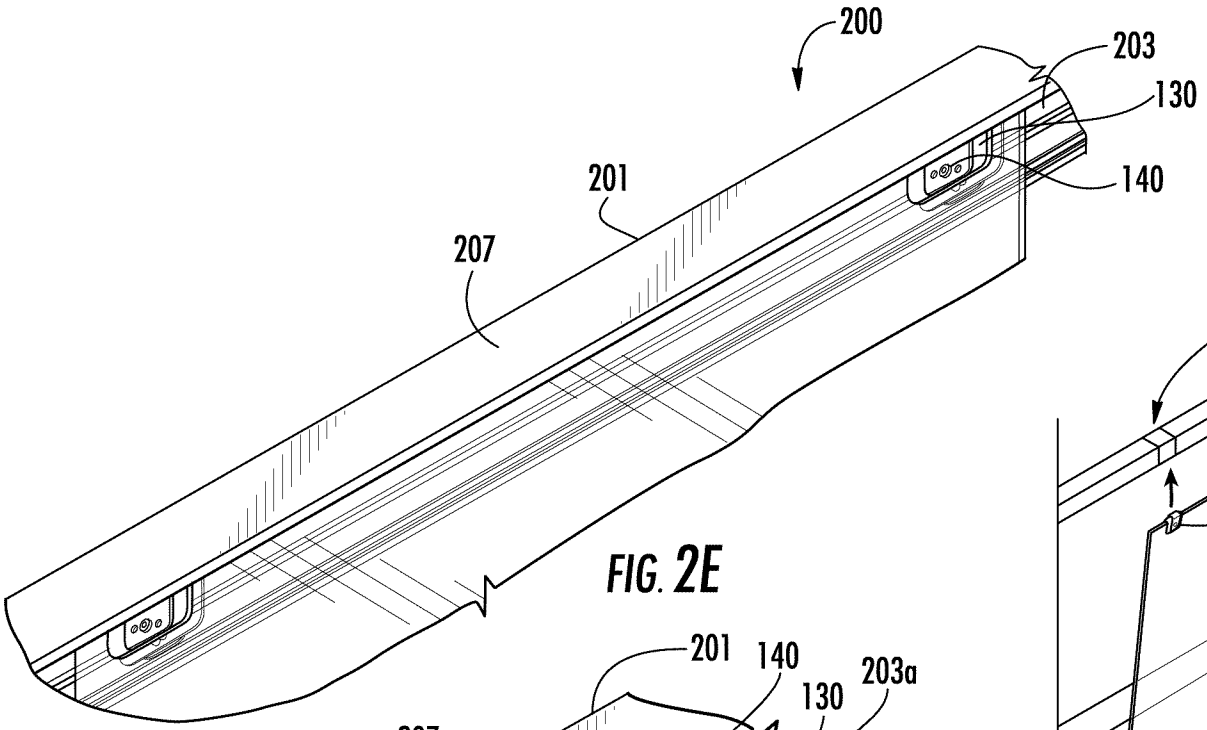
FIG. 2E is a partial perspective view of the shower door assembly of FIG. 1A showing a door panel positioned for installation or removal according to an exemplary embodiment.
Figure 2F:
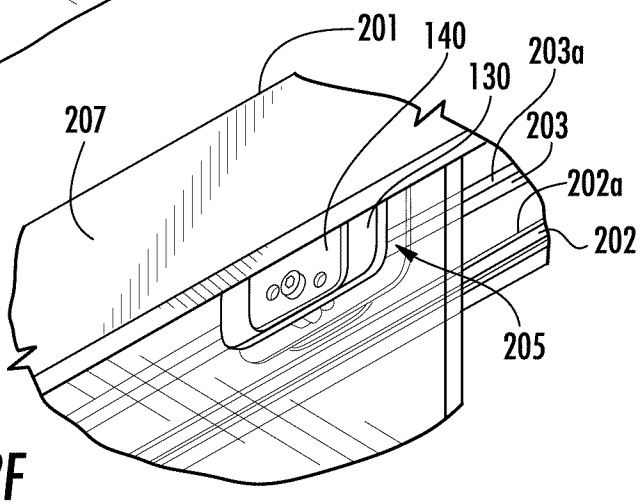
FIG. 2F is a partial perspective view of the shower door assembly of FIG. 2E.

Referring now to FIG. 2G, a method for installing and removing the outer and inner door panels 110 and 120 to the header assembly 200 is shown according to an exemplary embodiment. The installer lifts the inner door panel 120 relative to the header assembly 200 and inserts the rollers 150 through the notches 205, so as to engage each of the rollers 150 with the inner most lower rail 202 of the header 201 between the header wall 207 and the lip 202*a* of the lower rail 202. For the outer door panel 110, the installer similarly lifts the outer door panel 110 relative to the header assembly 200 and inserts the rollers 150 through the notches 205, so as to engage each of the rollers 150 with the outermost lower rail 202 of the header 201. As previously described, the header 201 may contain upper rails 203 each disposed above the lower rails 202. The upper rails 203 are configured to prevent the rollers 150 of the outer and inner door panels 110 and 120 from de-railing. The header 201 also includes a plurality of notches 205 defining a space or gap within each of the upper rails 203. The notches 205 are disposed at a middle position of the header 201. The notches 205 are configured to allow an installer to install and remove the door panels 110 and 120 onto/from the lower rails 202 of the header 201 by providing a space sufficient to receive the rollers 150 therethrough. As shown in FIGS. 2E and 2F, when the door panels 110 and 120 are at a centered position along the header 201, the rollers 150 are aligned with the notches 205, enabling installation and removal of the door panels 110 and 120. The installer may lift the door panel in a vertical direction relative to the header 201 and insert a roller 150 through a notch 205 on an upper rail 203, to facilitate engagement of the roller 150 with the lower rail 202. Similarly, the installer may remove the door panels 110 and 120 by aligning the roller 150 with the notch 205 and lifting the door panels 110 and 120 in a vertical direction so as to disengage the roller 150 from the lower rail 202 through the notch 205. In this way, the notches 205 facilitate the installation and removal of the outer and inner door panels 110 and 120 onto/from the header 201. In contrast, as shown in FIGS. 2C and 2D, when the door panels 110 and 120 are at another position along the header, the rollers 150 are not aligned with the notches 205, fixing the door panels 110 and 120 both laterally and vertically within the header rails 202 and 203.

Referring to FIGS. 2A and 2B, the header 201 further includes a pair of slots 209 disposed near an upper portion of the header 201 at opposite ends thereof. Each slot 209 is configured to receive a portion of the cleat 210 therein for coupling the header 201 to the fixed structure. The header 201 is configured to be coupled to the fixed structure at opposite ends via a pair of cleats 210. Each cleat 210 is generally planar and includes a flange extending outward, away from a planar portion of the cleat 210. The cleat 210 further includes a plurality of through holes 211 for receiving one or more screws or other mounting fasteners (e.g., bolts, etc.) therethrough. The cleat 210 is configured to be coupled to a fixed structure (e.g., a fixed wall of a shower or bathing enclosure, a fixed wall of a building, etc.) via two or more fasteners for example threaded screws 220 and anchors 221 as shown in FIGS. 2A and 2B. According to an exemplary embodiment, anchors 221 are configured to be inserted into respective holes drilled into the fixed structure (e.g., fixed wall of a shower or bathing enclosure). Each cleat 210 is configured to be coupled to the fixed structure by threadably engaging the screws 220 with the respective anchors 221, with the cleat 210 disposed (e.g., sandwiched, secured, coupled, etc.) therebetween. Each cleat 210 is configured to be positioned relative to the fixed structure that it is coupled to, such that a flange extends outward away from the fixed structure, to thereby couple the header 201 thereto. In this way, the header 201 may be coupled relative to the fixed structure by inserting the flanges of the cleats 210 into the respective slots 209 of the header 201.

Figure 7A:
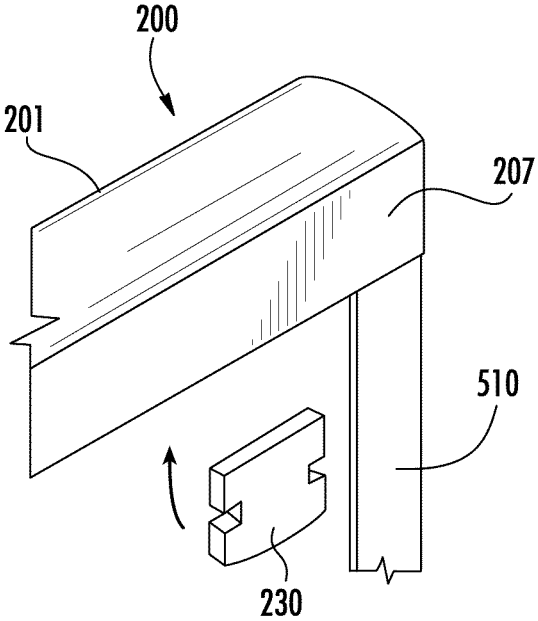
FIG. 7A is a perspective view of a method of installing a bumper in a header of the shower door assembly of FIG. 1A according to an exemplary embodiment.
Figure 7B:
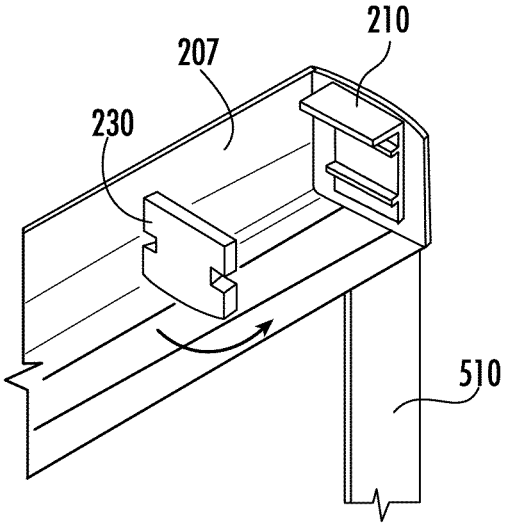
FIG. 7B is another perspective view of the method of installing a bumper of FIG. 7A.
Figure 7C:
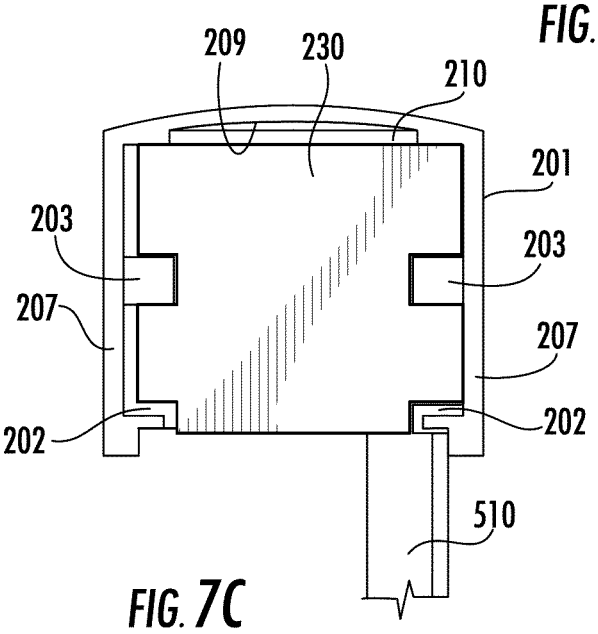
FIG. 7C is a side view of the bumper of FIG. 7A.

Referring to FIGS. 2A, 2B, and 7A-7C, the header assembly 200 includes a pair of bumpers 230 (e.g., keys, inserts, etc.) configured to be inserted into the header 201 at opposite ends of the header 201, respectively. The bumpers 230 are configured to establish, at least in part, the end points for translational movement of the door panels 110 and 120, at each end of the header 201. That is, the bumpers 230 provide a surface for contacting and/or engaging the door panels 110 and 120 when each of the door panels 110 and 120 reaches an extreme end point position at each end of the header 201 (e.g., a fully opened or a fully closed door panel position). The bumpers 230 are also configured to provide structural support and rigidity to the header 201 by acting as an end cap for each end of the header 201. That is to say, as shown in FIG. 7C, the bumpers 230 have an outer profile that is complementary to an inner profile of the header 201, such that when the bumpers 230 are inserted into the ends of the header 201, the bumpers 230 prevent relative movement of the side walls 204 of the header 201. Each bumper 230 engages (i.e., keys with) the lower rails 202 and the upper rails 203 of the header 201 below the slot 209, thereby preventing the header 201 from translating vertically.

According to an exemplary embodiment, the bumpers 230 are made (e.g., molded, extruded, etc.) from a rigid or a semi-rigid material or combination of materials, such as plastic, rubber, metal, or any other suitable material. According to an exemplary embodiment, the header 201 is a conventional bypass header configured to be used in shower or bathing enclosures. The header 201 may be made (e.g., extruded, molded, etc.) from a rigid or a semi-rigid material or combination of materials, such as aluminum, steel, plastic, or other material or combinations of materials suitable for the particular application of the header 201.

Figure 3A:
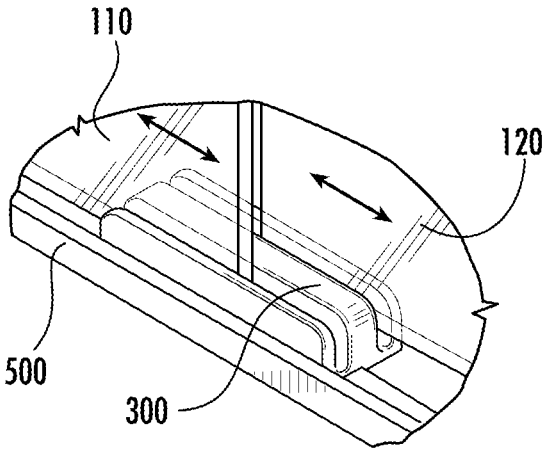
FIG. 3A is a partial perspective view of the shower door assembly of FIG. 1A including a guide member.
Figure 3B:
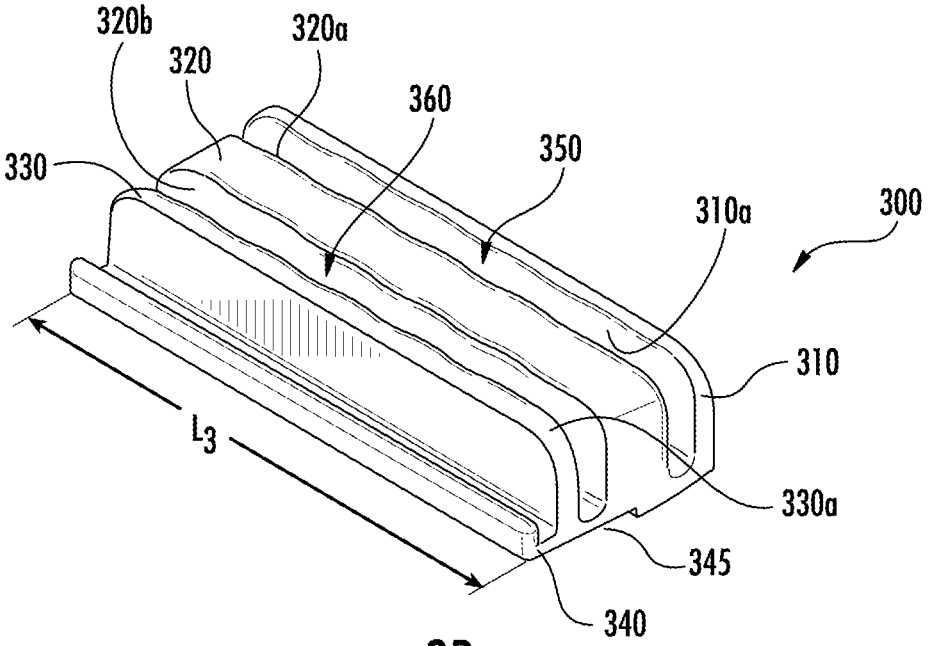
FIG. 3B is a perspective view of the guide member of FIG. 3A.
Figure 3C:
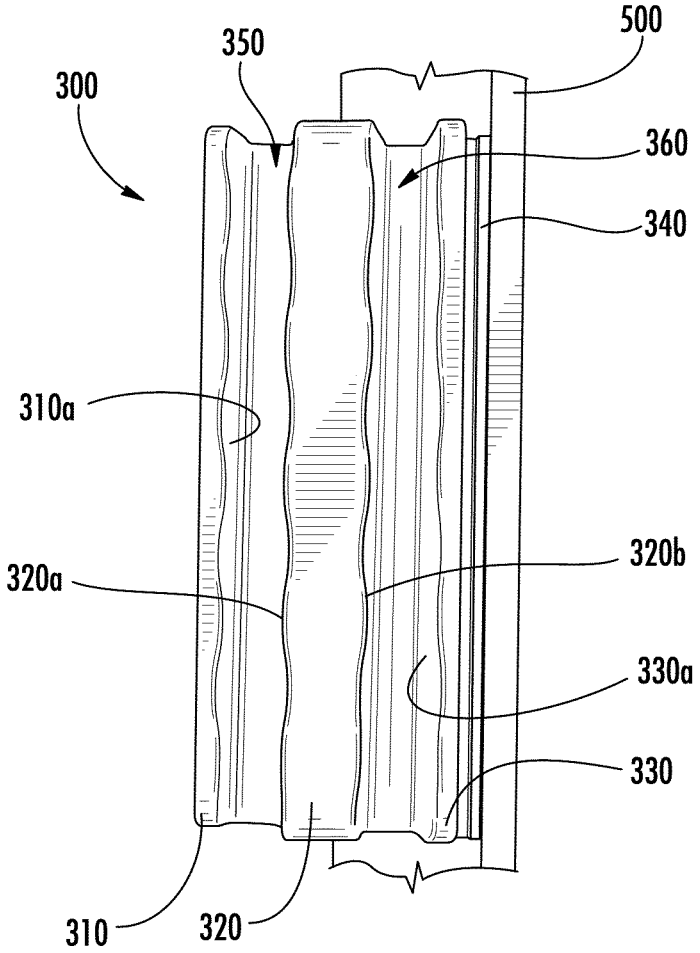
FIG. 3C is a top view of the shower door assembly and guide member of FIG. 3A.
Figure 3D:
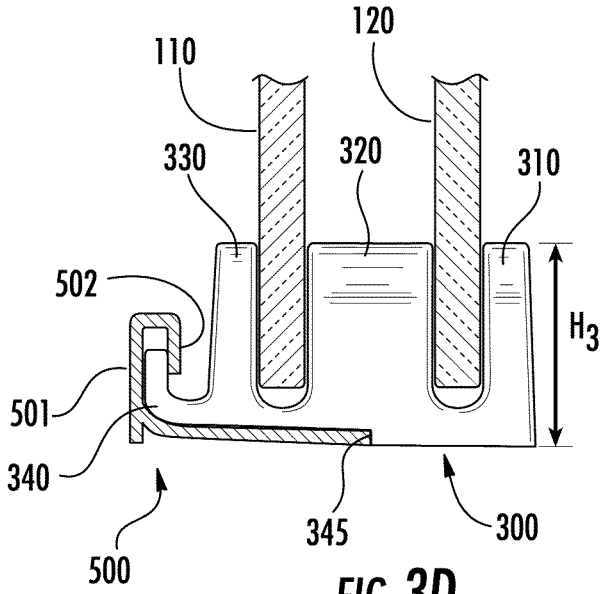
FIG. 3D is a side view of the shower door assembly and guide member of FIG. 3A.

Referring now to FIGS. 1A and 3A-3F, the shower door assembly 100 includes a guide member 300 according to an exemplary embodiment. The guide member 300 is configured to provide lateral support to a lower portion of each of the outer and inner door panels 110 and 120, and is configured to align the respective door panels 110 and 120 in a substantially vertical direction (as shown in FIG. 3D). For example, when the outer and inner door panels 110 and 120 are hung on the respective lower rails 202 of the header 201, a bottom portion of the door panels will bias outward due to the mounting arrangement of the roller on a side of each of the door panels. Thus, the guide member 300 aligns the door panels 110 and 120 within the assembly by providing lateral support to a bottom portion of each of the panels. The guide member 300 is further configured to guide the door panels 110 and 120 during opening and closing of the door panels 110 and 120. Furthermore, the guide member 300 provides a particular translational and/or tactile feel for a user when the user moves the door panels 110 and 120 between opened and closed positions. The guide member 300 also minimizes the amount of noise resulting from movement (e.g., sliding, etc.) of the door panels 110 and 120 relative to the guide member 300 by reducing a surface area of the door panels 110 and 120 in contract with the guide member 300.

According to an exemplary embodiment shown in FIGS. 2A-2B, the guide member 300 includes a flange 340 extending from a front portion thereof. The flange 340 is configured to be inserted into a pocket defined by a flange 501 and a lip 502 of the bottom track 500, such that the guide member 300 is coupled to and retained within the bottom track 500. That is, the flange 340 hooks underneath the lip 502 so as to retain the guide member 300 into position relative to the bottom track 500. The bottom track 500 is coupled to a bottom portion of a fixed structure, such as a floor, a base of a shower enclosure, a receptor for a bath, or other similar fixed structure. The bottom track 500 extends along a width of the shower enclosure, in a direction that is substantially parallel to the header 201. The a flange 501 extends upward from a planar portion of the bottom track 500. The flange 501 of the bottom track 500 includes a lip 502 extending from an upper portion of the flange. 501 and having a downward facing "L" shape. The flange 501 and the lip 502 collectively define the pocket 504 (e.g., gap, etc.) configured to receive the flange 340 of the guide member 300. The guide member 300 further includes an undercut portion 345 configured to receive the planar portion of the bottom track 500 therein (as shown in FIG. 2B). In this way, the guide member 300 sits flush on either of the bottom track 500 or the fixed structure (e.g., floor, base of the shower or bathing enclosure, etc.).

Still referring to FIGS. 2A-2B, the guide member 300 includes a rear wall 310, a middle wall 320, and a front wall 330. The rear wall 310 and the middle wall 320 cooperatively define a first channel 350 configured to receive a bottom portion of the inner door panel 120. The middle wall 320 and the front wall 330 cooperatively define a second channel 360 configured to receive a bottom portion of the outer door panel 110. The first and second channels 350 and 360 have a width sufficient to allow relative translational movement of the respective door panels 110 and 120 therein. The guide member 300 has a height sufficient to receive at least a portion of the door panels 110 and 120, but not to obstruct the ingress and/or egress of a user to/from the shower or bathing area. The middle wall 320 has a width sufficient to provide adequate spacing between the first and second channels to allow relative translational movement between the door panels 110 and 120. As shown in FIG. 2B, the flange 340 extends outward from a bottom portion of the front wall 330. The guide member 300 also has a length L (shown in FIG. 3) sufficient to allow for engagement of the door panels 110 and 120 within the guide member 300, regardless of the position of the door panels 110 and 120 within the shower door assembly 100 (e.g., at a fully opened or at a fully closed position). That is to say, the guide member 300 is positioned at the middle of the bottom track 500 such that regardless of the translational position of each of the outer and inner door panels 110 and 120 along the bottom track 500, at least a portion of the door panels will engage the guide member 300.

Figure 3E:
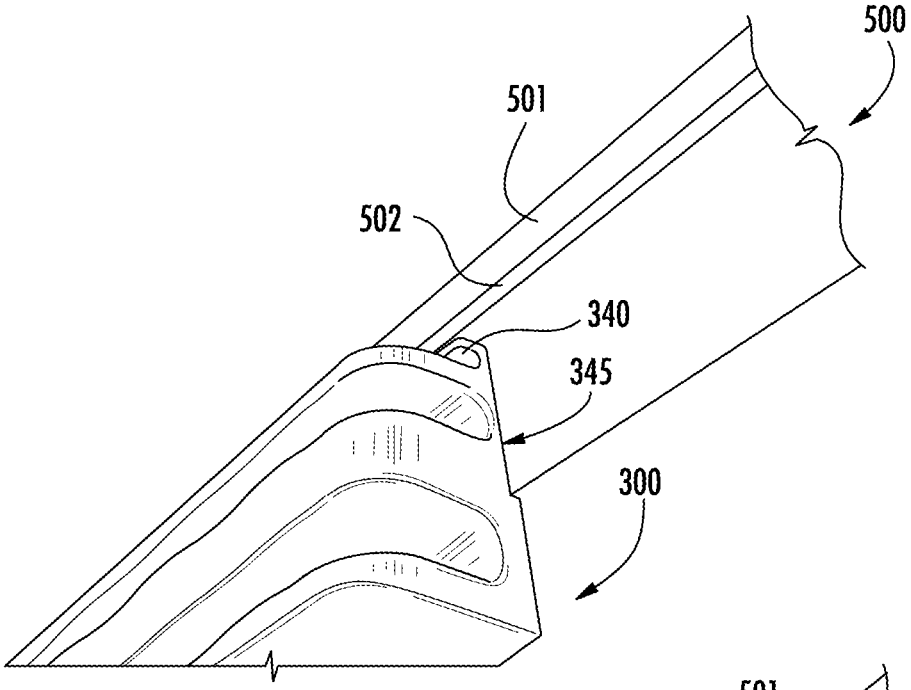
FIG. 3E is a perspective view of a method of installing the guide member of FIG. 3A in the shower door assembly according to an exemplary embodiment.
Figure 3F:
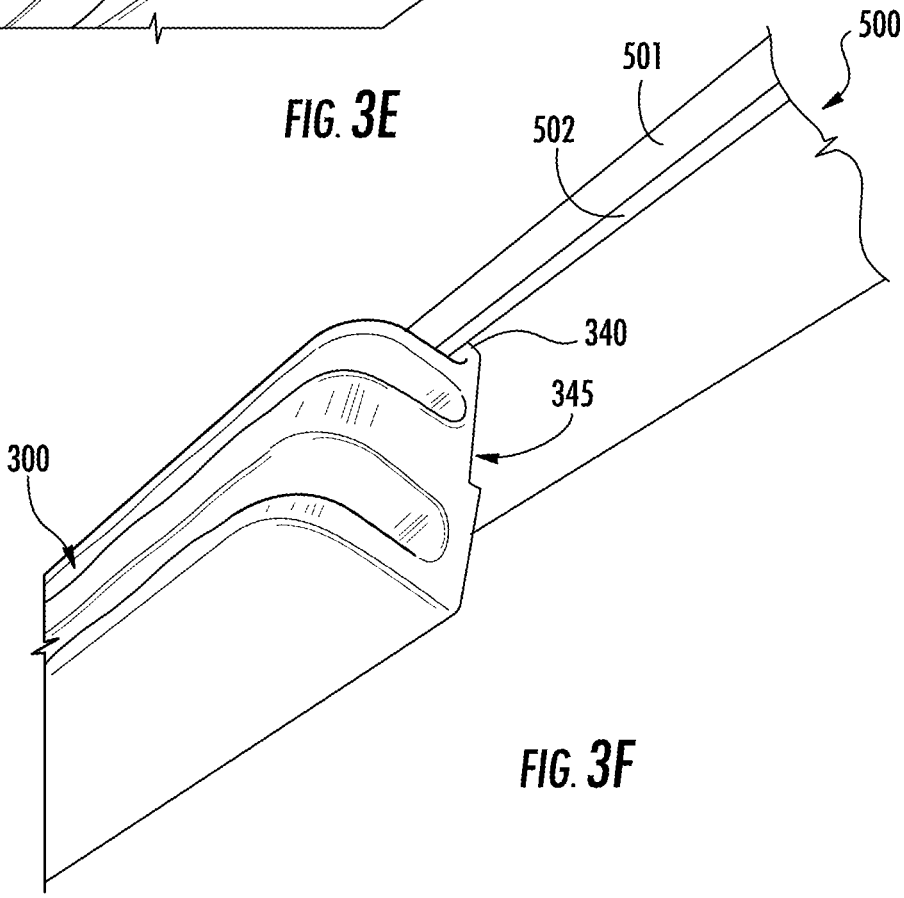
FIG. 3F is another perspective view of a method of installing the guide member of FIG. 3A in the shower door assembly according to an exemplary embodiment.

Referring to FIGS. 3A, 3E, and 3F, the guide member 300 is disposed on a bottom portion of a fixed structure, such as a floor, a base of a shower enclosure, a receptor for a bath, or other similar fixed structure. Referring now to FIGS. 3E and 3F, a method of installing the guide member 300 is shown according to an exemplary embodiment. An installer moves each of the outer and inner door panels 110 and 120 to an end of the header 201. The installer couples the guide member 300 to the bottom track 500 by rotating the guide member 300 such that the flange 340 is inserted (e.g., hooked) into the cavity between the lip 502 and the flange portion 501 of the bottom track 500. In other words, the flange 340 of the guide member 300 is inserted into the pocket 504 of the bottom track 500. The guide member 300 is inserted at a position along the bottom track 300 away from the middle, where there is no door panel 110 or 120 of the time of installation. The guide member is slid along the bottom track 500 toward the middle thereof, engaging a portion of each door panel 110 and 120 in each of the first and second channels 350 and 360. A sealant (e.g., silicone, etc.) may be applied around a periphery of the guide member 300 so as to prevent fluids (e.g., water, soap, etc.) from gathering or entering between the guide member 300 and the bottom track 500 or fixed structure. The sealant may be used to hold the guide member in a fixed position with respect to the fixed structure.

Referring now to FIGS. 3B and 3C, the rear wall 310 includes an inner surface 310*a* having a wavy configuration to minimize the surface area contact between the door panels 110 and 120 and the guide member 300 to improve the translational feel and reduce noise when moving (e.g., sliding, etc.) the door panels 110 and 120. That is, the surface 310*a* defines a plurality of protrusions and valleys extending along the length L of the guide member 300. Similarly, the middle wall 320 includes inner surfaces 320*a* and 320*b* each having a wavy configuration that is substantially the same as that of the inner surface 310*a*. Thus, the inner surfaces 310*a* and 320*a* are mirror images of each other. Likewise, the front wall 330 includes an inner surface 330*a* having a wavy configuration that is substantially the same as that of the inner surfaces 310*a*, 320*a*, and 320*b*. Each of the door panels 110 and 120 are configured to contact (i.e., engage) the plurality of protrusions defined by the inner surfaces 310*a*, 320*a*, 320*b*, and 330*a*, respectively. However, the door panels 110 and 120 do not contact (i.e., engage) the valleys of each of the inner surfaces. In this way, the guide member 300 minimizes the surface area contact between the door panels 110 and 120 and the inner surfaces 310*a*, 320*a*, 320*b*, and 330*a* of the guide member 300. This configuration, advantageously provides a particular tactile feel to a user moving the door panels 110 and 120 (e.g., when opening or closing the door panels), while reducing noise and the likelihood for door sticking or catching within the guide member 300.

Figure 4A:
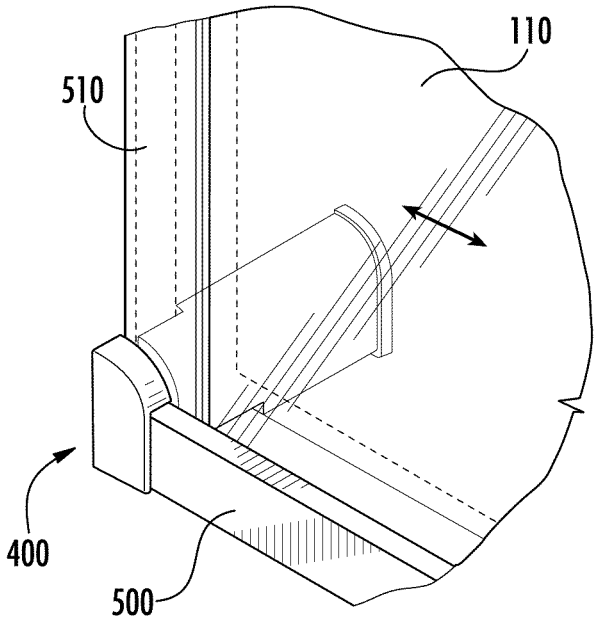
FIG. 4A is a partial perspective view of the shower door assembly of FIG. 1A including a door bumper.
Figure 4B:
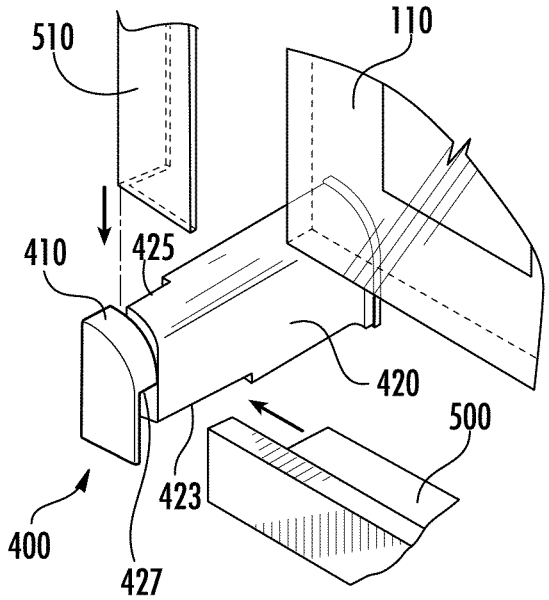
FIG. 4B is an exploded view of the shower door assembly of FIG. 4A.
Figure 4C:
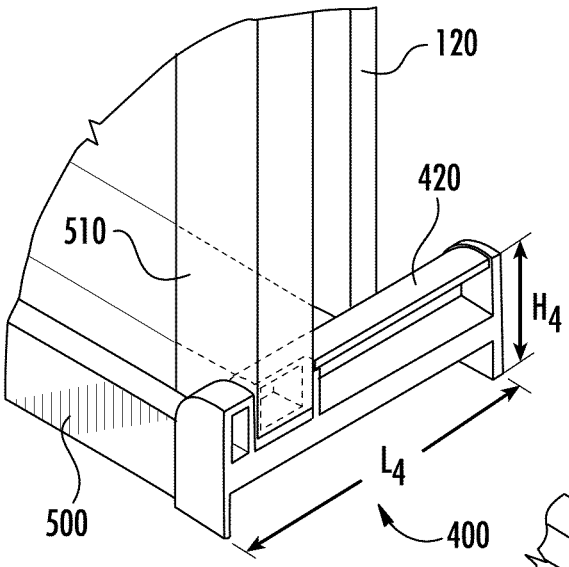
FIG. 4C is another partial perspective view of the shower door assembly of FIG. 1A including a door bumper.
Figure 4D:
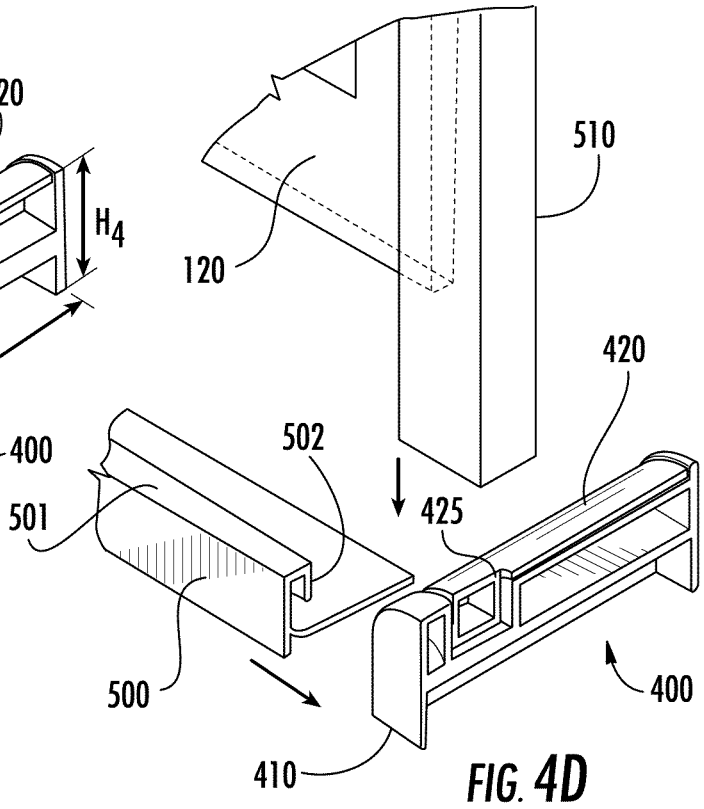
FIG. 4D is an exploded view of the assembly of FIG. 4C.

Referring now to FIGS. 4A-4D, the shower door assembly 100 includes plurality of door bumpers 400 according to an exemplary embodiment. FIGS. 4A-4B show a door bumper 400 installed at a left bottom corner of the shower door assembly 100, and FIGS. 4C-4D show a door bumper 400 installed at a right bottom corner of the shower door assembly 100. As shown in FIG. 4A, the door bumper 400 is coupled to a fixed structure, such as between a portion of the fixed floor (e.g., base of the shower or bathing enclosure, etc.) and a wall of a shower or bathing enclosure (i.e., at a corner where the floor or base and the wall meet), or between another fixed structure or fixed portion of a building. The bumper 400 is configured to locate and position a wall jamb 510 relative to the fixed structure within the shower door assembly 100. The bumper 400 is further configured to provide a soft, compressible surface for contacting (i.e., engaging) a side edge of the door panels 110 and 120, such as when a user is opening or closing the door panels. In this way, the bumper 400 protects the door panels 110 and 120 from being damaged from contacting the fixed structure. In addition, the door bumper 400 has a substantially continuous, over-molded design including notched areas that are configured to receive portions of the bottom track 500 for positioning the door bumper 400 relative to the shower assembly, and to position the wall jamb 510. The smooth, over-molded design also provides for an aesthetically pleasing appearance.

Still referring to FIGS. 4A-4D, the door bumper 400 includes a base 410 and an insert 420. According to an exemplary embodiment, the insert 420 is made of a rubber or other compressible, resilient material. The insert 420 is over-molded with the base 410, such that the insert 420 is integrally formed with the base 410. According to other exemplary embodiments, the insert 420 is coupled (e.g., glued, bonded, fastened, etc.) to the base 410. The insert 420 includes notches 423 and 427 for receiving at least a portion of the bottom track 500 therein to position the door bumper 400 within the assembly (e.g., on the floor or base of the shower or bathing enclosure). The insert 420 further includes a notch 425 for receiving at least a portion of the wall jamb 510 therein. In this way, the door bumper 400 allows for positioning the wall jamb 510 relative to the bottom track 500, while providing a seamless appearance with the respective door assembly components (e.g., the wall jamb 510 and the bottom track 500).

According to an exemplary embodiment, the base 410 is configured to be coupled to the fixed structure using, for example, a silicone adhesive, bonding, or other suitable fastener (e.g., screws, bolts, etc.). The base 410 includes a plurality of cavities disposed on a rear portion of the base for receiving, for example, a silicone sealant to hold the door bumper 400 relative to the fixed structure (e.g., wall of a bathing or shower enclosure). The door bumper 400 has a height $H_4$ sufficient to provide support for the wall jamb 510 and to receive at least a portion of the wall jamb 510 therein. The door bumper 400 also has a length $L_4$ sufficient to allow for selective engagement with both the door panels 110 and 120. According to an exemplary embodiment, the base 410 is made (e.g., molded, etc.) from a rigid or a semi-rigid material, such as a plastic, a metal, or other suitable material. The insert 420 is over-molded over the base 410 and has a contoured outer surface, so as to provide a seamless, continuous outer appearance. According to an exemplary embodiment, the insert 420 is made from a substantially compressible material, such as a rubber, a foam, a polymer, or another suitable, resilient material.

According to an exemplary embodiment, a user or an installer may position a bottom track 500 on the base before installing the door bumper 400 thereto. A portion of the bottom track 500 (e.g., the flange portion) provides a locating feature for positioning the door bumper 400 within the assembly. A user or an installer may apply an adhesive, such as a silicone adhesive, to a rear portion of the bumper 400 within the cavities of the bumper. The door bumper 400 is then positioned over the flange portion of the bottom track 500 such that the flange portion is received within the notch 427 of the bumper. The rear portion of the door bumper 400 may be placed against a fixed wall of, for example, a bathing or shower enclosure, such that the adhesive bonds or seals the bumper 400 in place.

A wall jamb 510 maybe coupled to the fixed wall with a portion of the wall jamb 510 inserted into the notches 425 and 427 of the door bumper 400. In this way, the door bumper 400 facilitates positioning of the wall jamb 510 within the shower or bathing area, relative to the fixed wall. According to an exemplary embodiment, the wall jamb 510 includes an adhesive disposed on a surface of the wall jamb to couple the wall jamb 510 to the fixed wall. According to an exemplary embodiment, the wall jamb 510 is made from a substantially transparent material, such as a polyethylene terephthalate that is glycol modified. In this way, the wall jamb 510 is substantially concealed from the view of a user due to its transparent appearance, but is durable and will not break down over time, as compared to some conventional wall jambs made from, for example, a polycarbonate material.

Figure 5A:
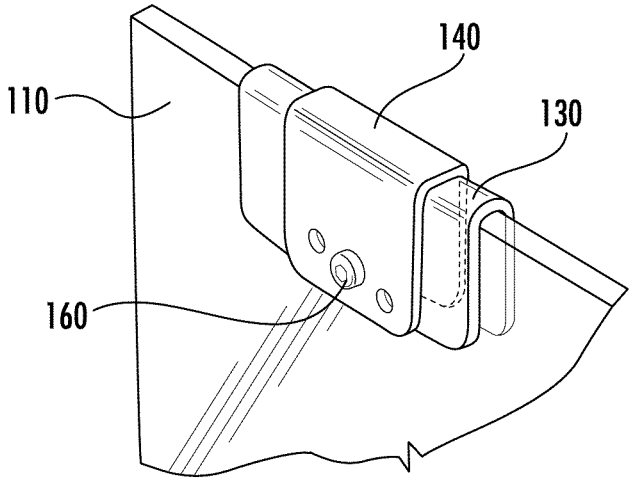
FIG. 5A is a partial perspective view of a shower door assembly according to an exemplary embodiment.
Figure 5B:
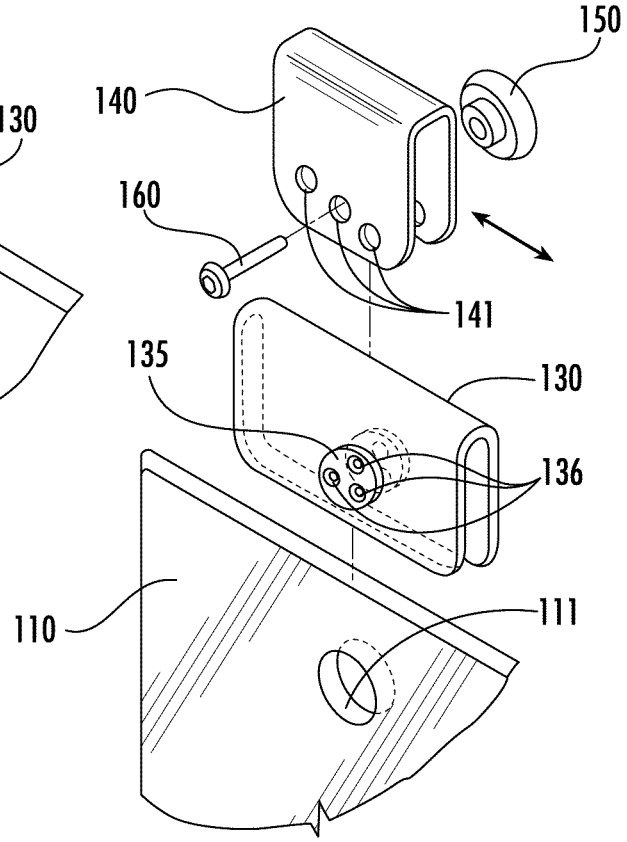
FIG. 5B is an exploded view of the shower door assembly of FIG. 5A.

Referring now to FIGS. 5A-5B, a portion of the shower door assembly 100 including a door bracket assembly is shown according to an exemplary embodiment. FIGS. 5A-5B show the outer door panel 110 including the bracket assembly, although it should be appreciated that, according to an exemplary embodiment, the bracket assembly may also be used on the inner door panel 120. The bracket assembly is configured to removably couple the door panel 110 to a lower rail 202 of the header 201 (shown in FIG. 5D) such that the door panel 110 is in rolling engagement with the lower rail 202 and can translate (e.g., roll, move, etc.) along the lower rail 202. According to an exemplary embodiment, each of the door panels 110 and 120 includes two bracket assemblies coupled to an upper portion of the respective door panel 110 and 120. The bracket assemblies may be spaced apart on each of the door panels 110 and 120 to enable a user or an installer to hang the door panels within the header 201 (i.e., on respective lower rails 202). According to an exemplary embodiment, the bracket assemblies are spaced apart at substantially the same distance as the notches 205 in the header 201.

According to an exemplary embodiment, each of the door panels 110 and 120 is a glass panel that is substantially planar. According to other exemplary embodiments (not shown), the door panels 110 and 120 are partially made of glass and/or include additional or different sections or materials, such as metal, wood, plastic, composite, or any other suitable material. According to other exemplary embodiments (not shown), the door panels 110 and 120 are substantially non-planar or include substantially non-planar portions.

Figure 5C:
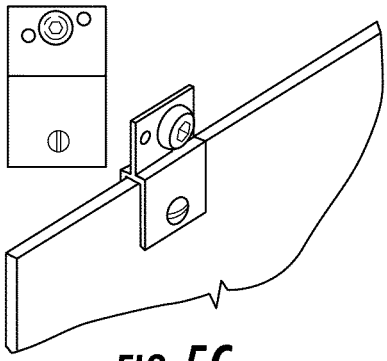
FIG. 5C (PRIOR ART)
FIG. 5C is a perspective view of a conventional shower door bracket according to the prior art.
Figure 5D:
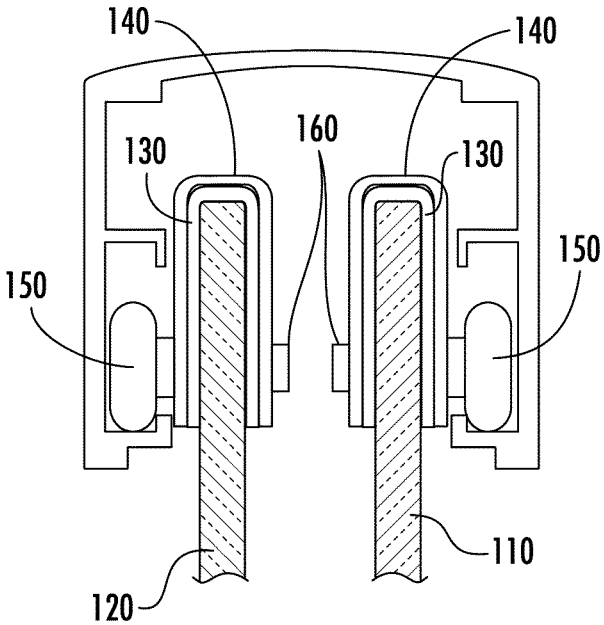
FIG. 5D is a partial side view of the shower door assembly of FIG. 1A including two door panels installed in a header.

Referring still to FIGS. 5A-5B, the door bracket assembly includes a bracket 140 coupled to an upper portion of the outer door panel 110. A bushing 130 is disposed between the bracket 140 and the outer door panel 110. The bracket 140 is coupled to the outer door panel 110 via an axle 160 and a roller 150 (shown in FIG. 5B). The bushing 130 is configured to allow for the selective adjustment of a vertical position of the outer door panels 110 and 120 relative to the header 201 via a plurality of mounting holes 136 disposed circumferentially about a portion (i.e., a barrel 135) of the bushing 130. Similarly, the bracket 140 includes a plurality of holes 141 disposed at different vertical positions above a bottom end of the bracket 140. The holes 141 of the bracket 140 may be selectively aligned with a mounting hole 136 on the bushing 130 (e.g., by moving the bracket 140 from left to right relative to the bushing 130) to set a desired vertical position of each of the door panels 110 and 120. In this manner, the vertical position of the door panels 110 and 120 may be selectively adjusted on the sides of the either door panels 110 and 120, rather than above the door panels 110 and 120, as is the case in some conventional shower door assemblies that utilize door brackets having flanges extending above the door (as shown in FIG. 5C). Accordingly, the disclosed bracket assembly allows for the use of a header, such as header 201, having a reduced height or upper clearance area above the lower rails 202, thereby potentially saving material costs and providing for greater design flexibility.

As shown in FIG. 5B, the outer door panel 110 includes a through hole 111 disposed near an upper portion of the door panel 110. According to an exemplary embodiment, each door panel 110 and 120 includes a second through hole disposed at an opposite end of the panel to couple a second door bracket assembly thereto. The bushing 130 includes two flanges extending downward to define a U-shaped member configured to slide over a top edge of the outer door panel 110. Each flange of the bushing 130 includes a cylindrical barrel 135 including a plurality of mounting holes 136 (e.g., three holes, etc.) disposed circumferentially therein. A portion of each barrel 135 projects inwardly toward the interior of the door panel 110 or 120. An interior portion of each barrel 135 is configured to be inserted into and to engage the through hole 111 of the outer door panels 110 and 120 when the bushing 130 is slid over the top edge thereof.

Still referring to FIG. 5B, the bracket 140 includes a pair of flanges extending downward and having a similar U-shaped design as the bushing 130. The bracket 140 also includes a plurality of through holes 141 (e.g., three holes, etc.) disposed at different vertical positions within each of the flanges. According to an exemplary embodiment, the through holes 141 are disposed along a diagonal direction on each of the flanges of the bracket 140. The bracket 140 is configured to slide over top of the bushing 130 such that one of the through holes 141 may be selectively aligned with one of the circumferentially disposed through holes 136 on the barrel 135 to set a desired vertical position of the door panel 110. The axle (e.g., bolt) 160 may be inserted into the aligned through holes 141 of the bracket 140 and the mounting holes 136 of the bushing 130 through the door panel 110. A roller 150 (e.g., a bearing wheel, etc.) may be coupled to an end of the axle 160, such that the roller 150 is permitted to rotate relative to the bracket 140 and the bushing 130. In this way, the user or installer may set a vertical position of the door panel 110 on a side of the door panel 110, rather than above the door panel, thereby enabling the use of a header 201 having a reduced height or upper clearance area.

According to an exemplary embodiment, to install the bracket assembly, the installer slides the bushing 130 over a top edge of the outer door panel 120 such that the barrel 135 is disposed within the through hole 111 of the door panel 110 or 120. The installer may press fit the bracket 140 over the bushing 130 such that one of the through holes 141 (e.g., the middle through hole 141) of the bracket 140 is aligned with a respective mounting hole 136 of the bushing 130. The installer can insert the axle 160 (e.g., bolt) into the aligned holes 136 and 141, through the inner door panel 110. The installer may couple a roller 150 to the axle 160 by threadably engaging the roller 150 with an end of the axle 160.

According to an exemplary embodiment, the vertical position of the door panel 110 may be adjusted, for example, if the door panel 110 or 120 needs to be moved higher relative to a shower enclosure base (e.g., to increase the clearance between the door panel and the base). The installer removes the axle 160 from the assembly and moves the bracket 140 (e.g., from left to right), and aligns the through hole 141 located at the lowest point of the bracket 140 with the corresponding mounting hole 136 in the bushing 130, effectively lifting the door panel in a vertical direction. The installer then inserts the axle 160 into the newly aligned holes 136 and 141. This process may be repeated for each bracket assembly as desired.

According to an exemplary embodiment, the bushing 130 is made from a rigid or a semi-rigid material or combinations of materials, such as a plastic, a rubber, a metal, or other similar material suitable for use in the shower door assembly 100. According to an exemplary embodiment, the bracket 140 is made from a rigid or a semi-rigid material, such as aluminum, plastic, steel, or any other material suitable for use in the shower door assembly 100.

The installer can repeat the same procedure for installing a door bracket assembly disclosed above at each end of the outer door panel 120. Similarly, as shown in FIG. 5D, the installer may repeat the same installation procedure for the inner door panel 110, but with the rollers 150 positioned on a side of the door panel 110 that is opposite of the position on the outer door panel 120.

Figure 6A:
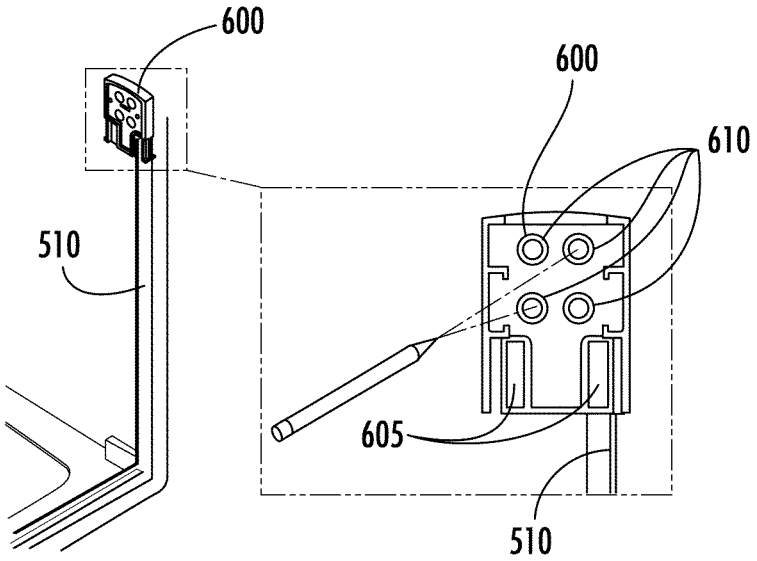
FIG. 6A is a perspective and schematic view of a method of installing the shower door assembly of FIG. 1A according to an exemplary embodiment.
Figure 6B:
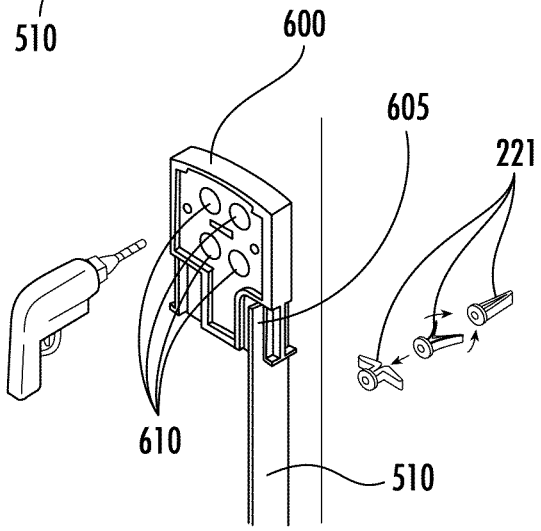
FIG. 6B is another perspective view of the method of installing the shower door assembly of FIG. 6A.
Figure 6C:
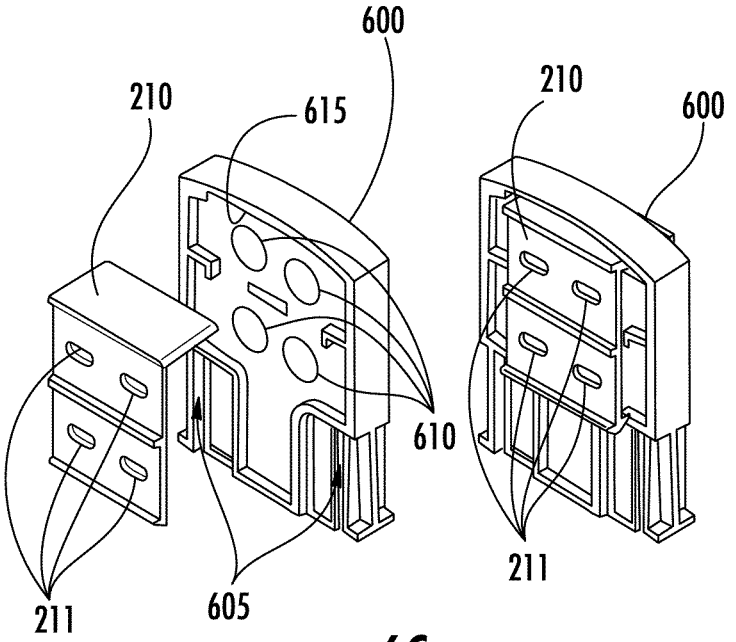
FIG. 6C is another perspective view of the method of installing the shower door assembly of FIG. 6A.

Referring now to FIGS. 6A-6E, a user or installer may use a template 600 to assist with positioning of the cleats 210 relative to a fixed wall of, for example, a shower or bathing enclosure and to couple the cleats 210 to the fixed wall. As shown in FIG. 6A, the template 600 has a generally rectangular shape and includes one or more vertical slots 605 disposed near a bottom end of the template 600. The vertical slots 605 are configured to receive an upper portion of the wall jamb 510, to locate the template relative to the fixed wall. As shown in FIG. 6C, the template 600 further includes a plurality of openings (i.e., holes) 610 that correspond to the through holes 211 of the cleat 210, for coupling the cleat 210 to the fixed wall. The template 600 includes a horizontal slot 615 disposed near an upper portion of the template 600. The horizontal slot 615 is configured to receive the flange of the cleat 210, so as to align the cleat 210 relative to the wall jamb 510.

Referring to FIG. 6A, the installer may place the template 600 on the fixed wall with an upper portion of the wall jamb 510 disposed within the vertical slots 605 of the template. The installer may then mark a plurality of holes through the corresponding plurality of openings 610. According to an exemplary embodiment, the installer may mark two holes diagonally on the fixed wall through two of the openings on the template 600. As shown in FIG. 6B, the installer may then drill holes (e.g., 5/16 inch diameter, etc.) at the two diagonal marks through the openings 610 of the template 600. After drilling the holes, the installer may then remove the template 600 and insert anchors 221 into each of the respective holes. According to another exemplary embodiment, the installer may remove the template 600 from the fixed wall before drilling the holes.

Figure 6D:
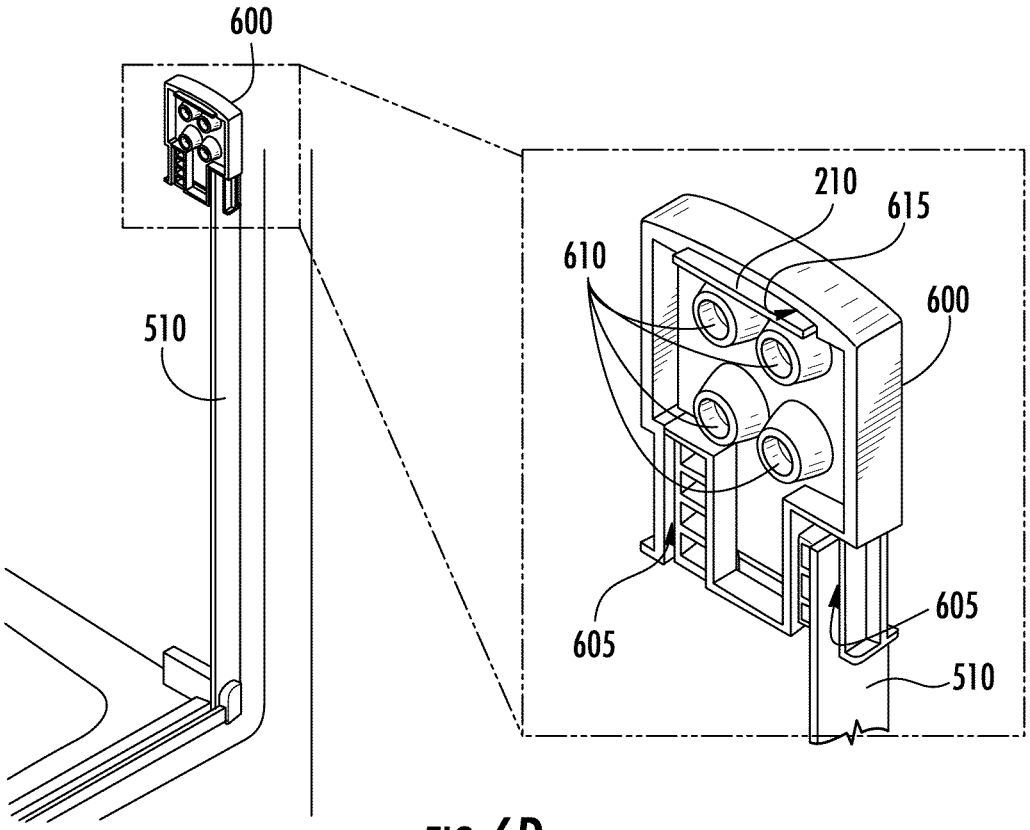
FIG. 6D is another perspective and schematic view of the method of installing the shower door assembly of FIG. 6A.
Figure 6E:
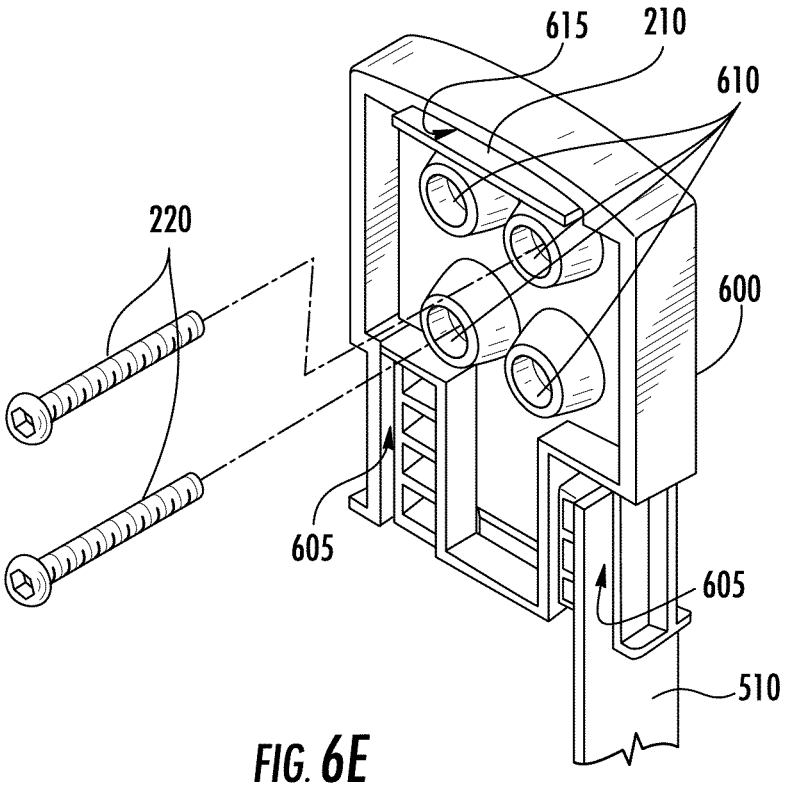
FIG. 6E is another perspective view of the method of installing the shower door assembly of FIG. 6A.

Referring to FIG. 6C, the installer may insert a cleat 210 into the template 600 so that the installer can align the cleat 210 into position on the fixed wall. As shown in FIGS. 6C and 6D, the cleat 210 is disposed within the template 600 such that the flange portion of the cleat is inserted into and extending through the horizontal slot 615 of the template 600. The planar portion of the cleat 210 rests adjacent a front side of the template 600. Referring to FIG. 6D, the installer can place the template 600, along with the cleat 210 inserted therein, against the fixed wall with the upper portion of the wall jamb 510 inserted into the vertical slot 605 of the template 600. The template 600 is oriented such that the front side of the template 600 and the flange portion of the cleat 210 both face outward away from the fixed wall. As shown in FIGS. 6B and 6E, the installer may insert one or more screws 220 through respective openings on the template 600 to threadably engage the respective anchors 221 and thereby couple the cleat 210 to the fixed wall. The installer may then remove the template 600 leaving the cleat 210 coupled to the fixed wall adjacent the wall jamb 510. The same procedure may be repeated at an opposite end of the shower or bathing area or enclosure to couple a second cleat 210 to, for example, another fixed wall.

The header 201 may then be connected to the cleats 210 according to an exemplary embodiment. The header 201 may be cut to a width sufficient to fit within, for example, a bathing or a shower enclosure between fixed walls of the enclosure. For example, the installer measures the distance above a pair of cleats 210 between, for example, fixed walls of a bathing or shower enclosure, to determine a required length of the header 201. The installer then cuts the header 201 to the required length. Once the header 201 is cut to the required length, the installer may couple the header 201 to the fixed walls by sliding the header 201 over the flange portion of each of the respective cleats 210, such that the flange portion is at least partially inserted into each of the slots 209 of the header 201 (see FIGS. 7B and 7C). As shown in FIGS. 7A-7C, the installer may then insert a pair of bumpers 230 into respective ends of the header 201 by inserting and twisting (i.e., turning) each of the bumpers 230 into position within the ends of the header 201. In this way, the bumpers add structural stability and rigidity to the header 201 and minimize or eliminate lateral and vertical movement of the header 201.

The shower door assemblies and the methods of installation disclosed herein provide for: a shower door guide member that reduces door noise and provides improved translational feel to a user; a door bumper that includes features for locating the bumper relative to other components of the assembly and that is aesthetically pleasing; a door bracket for hanging shower doors that is configured to reduce the overall size (e.g., height, clearance, etc.) of the header; and an installation sequence that utilizes templates and locating elements that simplify the installation of various components of the shower door assembly.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A guide member for a sliding shower door assembly, the guide member comprising:

a first wall;

a second wall offset from the first wall defining a channel therebetween, wherein the channel is configured to receive a portion of a door panel;

wherein at least one of the first wall or the second wall includes a wavy surface defined by a plurality of protrusions and valleys.

2. The guide member of claim 1, wherein only the plurality of protrusions of the wavy surface are configured to be engaged by the door panel.

3. The guide member of claim 1, wherein the channel is cooperatively defined by an inner surface of the first wall and an inner surface of the second wall, wherein the inner surfaces of the first and second walls each include the plurality of protrusions and valleys.

4. The guide member of claim 1, wherein the first wall and the second wall are cooperatively configured to maintain the door panel in a substantially vertical direction.

5. The guide member of claim 1, further comprising a flange extending from a bottom portion of the guide member, wherein the flange is configured to be inserted into a bottom track of a shower assembly.

6. The guide member of claim 5, further comprising an undercut portion configured to receive a portion of the bottom track of the shower assembly.

7. A guide member for a sliding shower door assembly, the guide member comprising:

a first wall;

a second wall offset from the first wall defining a first channel therebetween, wherein the first channel is configured to receive a portion of a first door panel; and a third wall offset from the second wall defining a second channel therebetween, wherein the second channel is configured to receive a portion of a second door panel;

wherein at least one of the first wall, the second wall, or the third wall includes a surface defined by a plurality of protrusions and valleys;

wherein the plurality of protrusions and valleys collectively define a wavy surface profile.

8. The guide member of claim 7, wherein only the plurality of protrusions of the surface are configured to be engaged by at least one of the first door panel or the second door panel.

9. The guide member of claim 7, wherein the first channel is cooperatively defined by an inner surface of the first wall and a first inner surface of the second wall, wherein the inner surface of the first wall and the first inner surface of the second wall each include the plurality of protrusions and valleys.

10. The guide member of claim 7, wherein the second channel is cooperatively defined by an inner surface of the third wall and a second inner surface of the second wall, wherein the inner surface of the third wall and the second inner surface of the second wall each include the plurality of protrusions and valleys.

11. The guide member of claim 7, wherein the first wall and the second wall are cooperatively configured to maintain the first door panel in a substantially vertical direction; and wherein the third wall and the second wall are cooperatively configured to maintain the second door panel in a substantially vertical direction.

12. The guide member of claim 7, further comprising a flange extending from a bottom portion of the third wall, wherein the flange is configured to be inserted into a bottom track of a shower assembly.

13. The guide member of claim 12, further comprising an undercut portion configured to receive a portion of the bottom track of the shower assembly.

14. A guide member for a sliding shower door assembly, the guide member comprising:

a rear wall;

a middle wall offset from the rear wall defining a first channel therebetween, wherein the first channel is configured to receive a portion of a first door panel; and a front wall offset from the middle wall defining a second channel therebetween, wherein the second channel is configured to receive a portion of a second door panel;

wherein at least one of the rear wall, the middle wall, or the front wall includes a surface defined by a plurality of protrusions and valleys; and wherein the plurality of protrusions and valleys collectively define a wavy surface profile.

15. The guide member of claim 14, wherein only the plurality of protrusions of the surface are configured to be engaged by at least one of the first door panel or the second door panel.

16. The guide member of claim 14, wherein the first channel is cooperatively defined by an inner surface of the rear wall and a first inner surface of the middle wall, wherein the inner surface of the rear wall and the first inner surface of the middle wall each include the plurality of protrusions and valleys.

17. The guide member of claim 14, wherein the second channel is cooperatively defined by an inner surface of the front wall and a second inner surface of the middle wall, wherein the inner surface of the front wall and the second inner surface of the middle wall each include the plurality of protrusions and valleys.

18. The guide member of claim 14, wherein the rear wall and the middle wall are cooperatively configured to maintain the first door panel in a substantially vertical direction; and wherein the front wall and the middle wall are cooperatively configured to maintain the second door panel in a substantially vertical direction.

19. The guide member of claim 14, further comprising a flange extending from a bottom portion of the front wall, wherein the flange is configured to be inserted into a bottom track of a shower assembly.

* * * * *